US009410525B2

(12) United States Patent
Powell et al.

(10) Patent No.: US 9,410,525 B2
(45) Date of Patent: Aug. 9, 2016

(54) VALVE CONTROLLED COMBUSTION SYSTEM

(71) Applicant: DENSO International America, Inc., Southfield, MI (US)

(72) Inventors: Patrick Powell, Farmington Hills, MI (US); Michael Bima, Milford, MI (US)

(73) Assignee: Denso International America, Inc., Southfield, MI (US)

( * ) Notice: Subject to any disclaimer, the term of this patent is extended or adjusted under 35 U.S.C. 154(b) by 249 days.

(21) Appl. No.: 13/960,912

(22) Filed: Aug. 7, 2013

(65) Prior Publication Data

US 2015/0040851 A1 Feb. 12, 2015

(51) Int. Cl.

| | |
|---|---|
| ***F02P 23/04*** | (2006.01) |
| ***H01T 13/00*** | (2006.01) |
| ***F02P 9/00*** | (2006.01) |
| ***F02P 15/00*** | (2006.01) |
| ***H01T 13/30*** | (2006.01) |
| ***H01T 21/02*** | (2006.01) |
| *H01T 13/26* | (2006.01) |
| *H01T 13/50* | (2006.01) |

(52) U.S. Cl.

CPC ..... *F02P 9/002* (2013.01); *F02P 15/006* (2013.01); *H01T 13/00* (2013.01); *H01T 13/30* (2013.01); *H01T 21/02* (2013.01); *H01T 13/26* (2013.01); *H01T 13/50* (2013.01)

(58) Field of Classification Search

CPC ..... F02P 23/04; F02P 23/045; F02P 9/002; F02P 15/006; H01T 13/00; H01T 21/02

See application file for complete search history.

(56) References Cited

U.S. PATENT DOCUMENTS

| | | | | |
|---|---|---|---|---|
| 2,872,496 | A * | 2/1959 | Chen | 123/169 R |
| 4,221,174 | A | 9/1980 | Smith et al. | |
| 4,397,273 | A * | 8/1983 | Folkerts | F23Q 7/001 123/145 A |
| 4,529,373 | A | 7/1985 | Ortlinghaus | |
| 4,726,336 | A * | 2/1988 | Hoppie | F02P 23/04 123/143 B |
| 4,898,126 | A | 2/1990 | Merritt | |
| 5,144,924 | A | 9/1992 | Paro | |
| 5,329,901 | A | 7/1994 | Onishi | |
| 5,522,357 | A | 6/1996 | Nogi et al. | |
| 6,325,039 | B1 | 12/2001 | Goto | |
| 6,925,983 | B2 | 8/2005 | Herden et al. | |
| 7,281,514 | B2 | 10/2007 | Hill et al. | |
| 2008/0264371 | A1* | 10/2008 | Taido et al. | 123/143 B |
| 2009/0314233 | A1* | 12/2009 | Zajac | F02B 41/08 123/58.9 |
| 2012/0282555 | A1 | 11/2012 | Cody et al. | |

FOREIGN PATENT DOCUMENTS

| | | |
|---|---|---|
| EP | 0020280 | 12/1980 |
| EP | 1033535 | 3/1999 |

(Continued)

*Primary Examiner* — Lindsay Low
*Assistant Examiner* — Jacob Amick
(74) *Attorney, Agent, or Firm* — Harness, Dickey & Pierce, P.L.C.

(57) ABSTRACT

An internal combustion engine combustion system, including an ignition element and an ignition actuation member. The ignition element is configured to ignite an air-fuel mixture compressed within a combustion chamber of an internal combustion engine. The ignition actuation member is movable between a first position in which the ignition actuation member prevents ignition of the air-fuel mixture when present in the combustion chamber, and a second position in which the ignition actuation member permits ignition of the air-fuel mixture by exposing the ignition element to the air-fuel mixture when the air-fuel mixture is present in the combustion chamber.

4 Claims, 7 Drawing Sheets

(56) References Cited

FOREIGN PATENT DOCUMENTS

| | | |
|---|---|---|
| EP | 1033535 | 9/2000 |
| EP | 1452730 | 9/2004 |
| EP | 1500881 | 1/2005 |
| EP | 1287291 | 8/2007 |
| EP | 1916413 | 4/2008 |
| EP | 2383519 | 11/2011 |
| WO | WO 01/94846 | 12/2001 |

* cited by examiner

VALVE CONTROLLED COMBUSTION SYSTEM

FIELD

The present disclosure relates to valve controlled combustion systems.

BACKGROUND

This section provides background information related to the present disclosure, which is not necessarily prior art.

Internal combustion engines ("ICEs") typically include a combustion chamber, an intake and exhaust port, a compression device, a fuel delivery system, and an ignition device. ICEs place the ignition device into constant contact with the combustible mixture of air and fuel and control the ignition of that mixture by intermittent activation of the ignition device. For example, intermittent operation of a spark plug, activated by a high voltage pulse to produce a plasma flame kernel. However, in order to achieve higher fuel efficiency, the compression ratios of ICEs are growing higher, and the air-fuel mixtures are becoming leaner. This requires ignition devices such as spark plugs to use higher voltages for consistent combustion.

Furthermore, the ignition devices are exposed to the high ranges of pressures, temperatures, and chemical mixtures that exist in the combustion chamber during the entire engine cycle. This exposure can lead to degradation of the ignition device, including buildup of soot, which can result in inconsistent combustion and loss of fuel economy and power. Additionally, ignition devices in ICEs utilizing compressed natural gas ("CNG") as the fuel tend to build up soot more quickly than ICEs operating on traditional fuels, such as gasoline, for example. This additional buildup can require more frequent maintenance, often making CNG ICEs impractical or too costly for certain applications.

The geometry and operation of sparkplugs also makes controlling the propagation of the flame front difficult. This can lead to premature flameout resulting in inconsistent combustion, and loss of fuel economy and power.

SUMMARY

This section provides a general summary of the disclosure, and is not a comprehensive disclosure of its full scope or all of its features.

The present teachings provide for an internal combustion engine combustion system, including an ignition element and an ignition actuation member. The ignition element is configured to ignite an air-fuel mixture compressed within a combustion chamber of an internal combustion engine. The ignition actuation member is movable between a first position in which the ignition actuation member prevents ignition of the air-fuel mixture when present in the combustion chamber, and a second position in which the ignition actuation member permits ignition of the air-fuel mixture by exposing the ignition element to the air-fuel mixture when the air-fuel mixture is present in the combustion chamber.

The present teachings also provide for an internal combustion engine combustion system, including an ignition surface, an ignition actuation member, an isolation cavity, an isolation member, and an actuating device. The ignition surface is configured to be heated to a temperature sufficient to create an ignition element to ignite an air-fuel mixture compressed within a combustion chamber of the internal combustion engine. The ignition actuation member is movable between a first position in which the ignition actuation member prevents ignition of the air-fuel mixture when present in the combustion chamber, and a second position in which the actuation member permits ignition of the air-fuel mixture by exposing the ignition element to the air-fuel mixture when the air-fuel mixture is present in the combustion chamber. The isolation member seals the ignition surface within the isolation cavity in the first position. The actuating device is configured to move the ignition actuation member between the first and second positions.

The present teachings further provide for a method of operating an internal combustion engine. The method includes moving an ignition actuation member from a first position, in which the ignition actuation member prevents ignition of an air-fuel mixture present in a combustion chamber of an internal combustion engine by preventing exposure of an ignition element to the air-fuel mixture therein, to a second position in which the ignition actuation member permits ignition of the air-fuel mixture by permitting exposure of the ignition element to the air-fuel mixture, and returning the ignition actuation member to the first position after ignition of at least a portion of the air-fuel mixture.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 8:
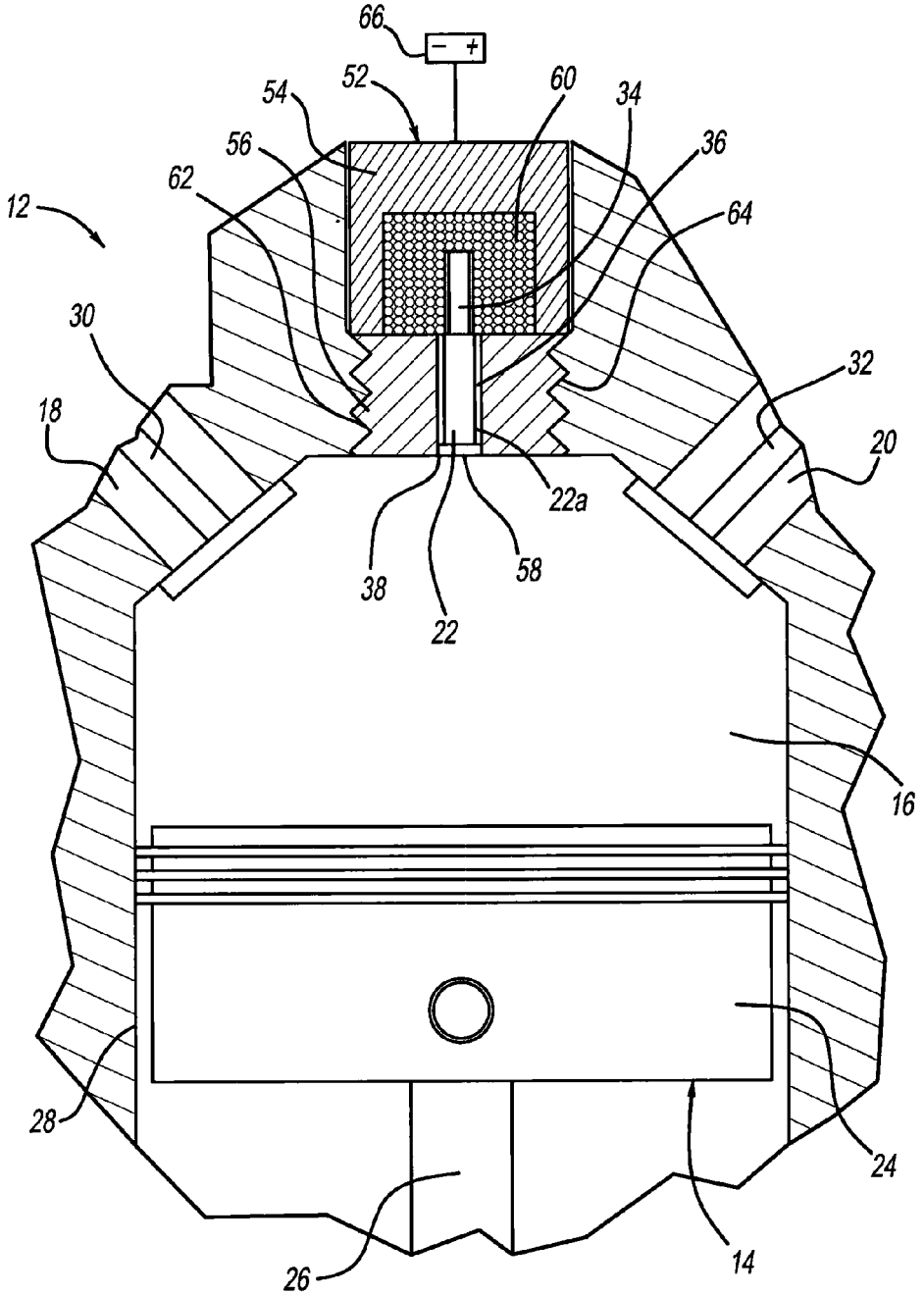
FIG. 8 is a cut-away view of a combustion chamber and ignition elements associated therewith of the internal combustion engine in a fifth configuration with an ignition actuation member in a first position.
Figure 9:
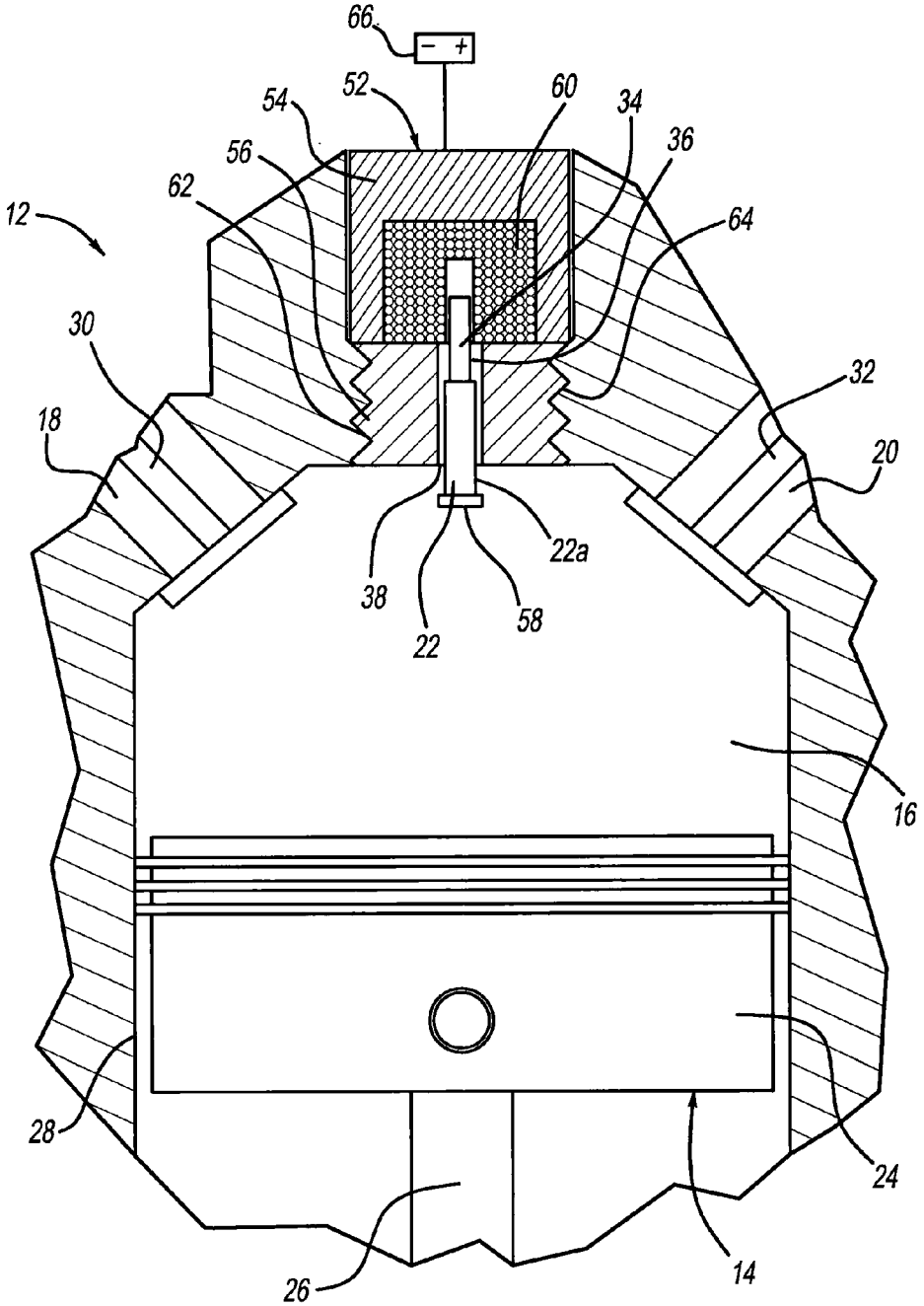
Figure 10:
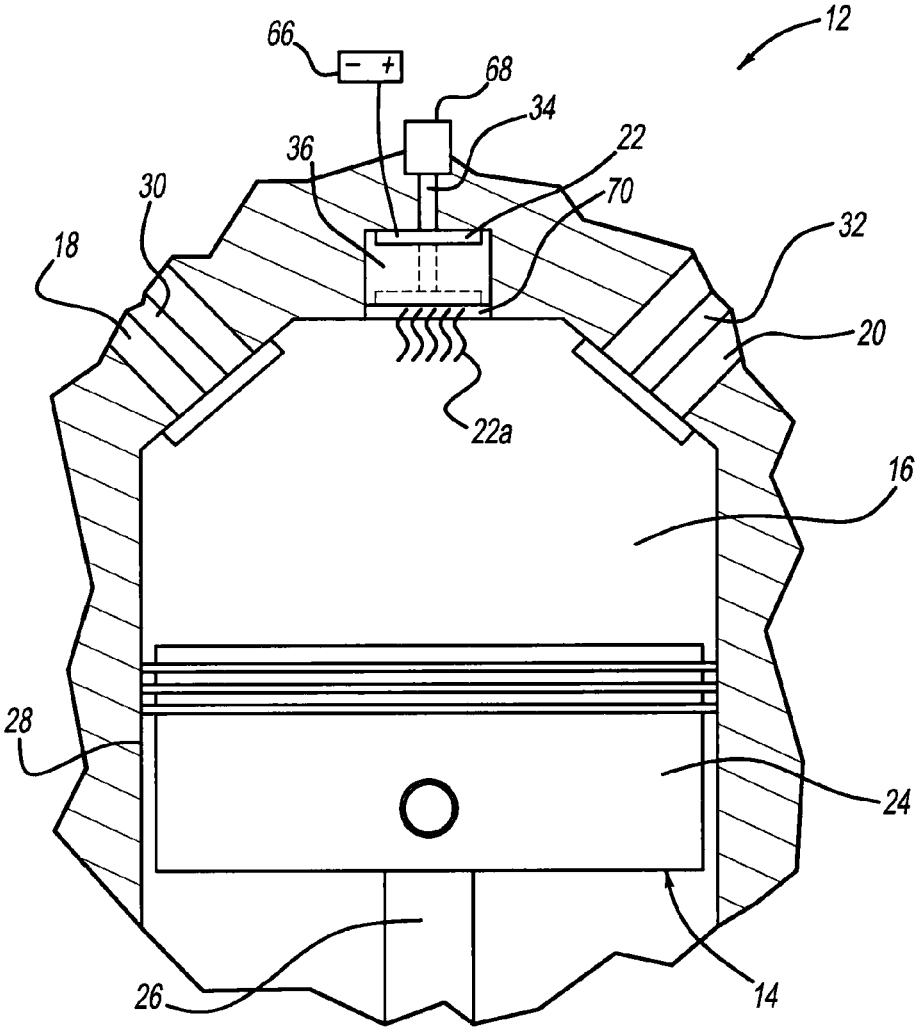

FIG. 9 is a cut-away view of a combustion chamber and ignition elements associated therewith of the internal combustion engine of FIG. 8 with the ignition actuation member in a second position; and FIG. 10 is a cut-away view of a combustion chamber and ignition elements associated therewith of the internal combustion engine in a sixth configuration with an ignition actuation member in a first and second position.

Corresponding reference numerals indicate corresponding parts throughout the several views of the drawings.

DETAILED DESCRIPTION

Example embodiments will now be described more fully with reference to the accompanying drawings.

Figure 1:
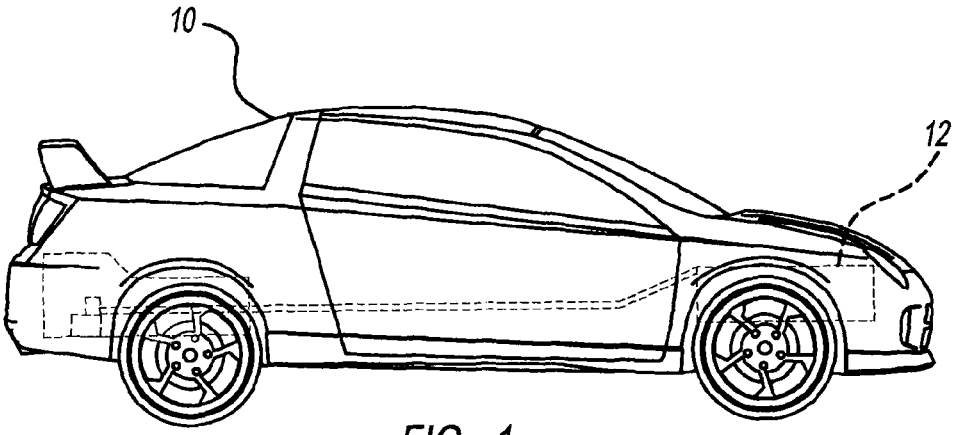
FIG. 1 is a representative vehicle including an internal combustion engine in accordance with the present teachings.

The present teachings are directed to a combustion system and method for use in an internal combustion engine ("ICE"). The ICE can be of any type, such as a piston-cylinder engine or a Wankel engine, for example. The ICE may be located within a vehicle, such as an automobile, truck, machinery, aircraft, watercraft, or any other vehicle to provide power for locomotion, for example. However, it is also contemplated that the ICE could be used in other applications with or without a vehicle such as an electrical generator or to operate machinery, for example. FIG. 1 illustrates an example of a vehicle 10 with an ICE 12.

FIGS. 2-10 illustrate cut-away views of the inside of a portion of the ICE 12 in various configurations. The ICE 12 can include a compression device 14, a combustion chamber 16, an intake port 18, an exhaust port 20, an ignition device 22, and an ignition element 22*a*.

The compression device 14 can include a piston 24 coupled to a piston rod 26 disposed within a cylinder 28, such as that illustrated in FIGS. 2-10. However, the compression device 14 can be any other type of compression device found in any other type of ICE, such as a rotor in a Wankel engine, for example.

The combustion chamber 16 is configured to contain an air-fuel mixture under compression by the compression device 14. The combustion chamber 16 is further configured to contain the combustion of the air-fuel mixture when the air-fuel mixture is ignited by the ignition element 22*a*.

The ignition device 22 can be a typical spark plug and the ignition element 22*a* can be a spark generated to ignite the air-fuel mixture. The ignition device 22 can also be a geometric shape, such as a ring, toroid, plate, cylinder, sphere, or any other geometry, and the ignition element 22*a* can be the surface of ignition device 22 and be configured to be heated to a temperature sufficient to ignite the air-fuel mixture within the combustion chamber. The ignition element 22*a* can be heated, for example, by electrical resistance, infrared, laser, or induction heating. The ignition device 22 can alternatively be configured to emit the ignition element 22*a* as radiation, such as infrared, or laser radiation for example, the radiation configured to ignite the air-fuel mixture within the combustion chamber. When the ignition device 22 is operated by an electrically powered means, the combustion system can be connected to a power source 66, such as a battery, an alternator, or a power grid, for example. The shape of the ignition element 22*a* can be configured to control the propagation of a flame front during combustion to ensure more complete combustion within the combustion chamber 16.

During the typical operation of a piston-cylinder type ICE 12, the compression device 14 compresses the air-fuel mixture within the combustion chamber 16 during a compression stroke of the piston 24. During the compression stroke, the volume of the combustion chamber 16 is decreased, causing the pressure of the air-fuel mixture to increase. At or near a combustion pressure, the ignition element 22*a* ignites the air-fuel mixture. The ignition of the air-fuel mixture can start with a plasma flame kernel originating at the ignition element 22*a*. The combustion of the air-fuel can propagate from the ignition element 22*a* through the air-fuel mixture in the combustion chamber 16 by the flame front. The combustion of the air-fuel mixture forces the piston 24 to begin a power stroke, in which the volume of the combustion chamber 16 increases, and the piston 24 performs work, such as linear motion from the piston 24, rotation of a crankshaft (not shown), or rotation of a rotor of an electrical generator (not shown), for example.

The intake port 18 can include an intake valve 30. The intake valve 30 can be configured to move between an open position and a closed position to selectively allow air to pass through the intake port 18 and enter the combustion chamber 16 when the intake valve 30 is in the open position. The air-fuel mixture for combustion can be created by mixing fuel with air before the air enters the combustion chamber 16. Alternatively, fuel can be injected separately into the combustion chamber 16 and allowed to mix with the air in the combustion chamber 16 to create the air-fuel mixture therein. The fuel can enter the combustion chamber separately through a fuel injector (not shown). The fuel can be any type of fuel used in ICEs, such as gasoline, diesel, bio-diesel, natural gas, ethanol, or any other type of fuel, or blend of fuels.

When the intake valve 30 is in the closed position, the intake valve 30 prevents the air-fuel mixture from passing through the intake port 18. During the typical operation of a piston-cylinder type ICE 12, the intake valve 30 will generally be in the open position during an intake stroke of the piston 24. The intake valve 30 would generally be in the closed position during compression, power, and exhaust strokes of the piston 24. However, it is known that variations on the timing of opening or closing the intake valve 30 may be used.

The exhaust port 20 can include an exhaust valve 32. The exhaust valve 32 can be configured to move between an open position and a closed position to selectively allow combustion gases, along with any uncombusted air and fuel, to pass through the exhaust port 20 and exit the combustion chamber 16 when the exhaust valve 32 is in the open position. During the typical operation of a piston-cylinder type ICE 12, the exhaust valve 32 will generally be in the open position during an exhaust stroke of the piston 24. The exhaust valve 32 would generally be in the closed position during intake, compression, and power strokes of the piston 24. However, it is known that variations in the timing of opening or closing the exhaust valve 32 may be used.

An ignition actuation member 34 can selectively isolate the ignition element 22*a* from communication with the combustion chamber 16 in a first position, and selectively allow communication between the ignition element 22*a* and the combustion chamber 16 in a second position. The ignition actuation member 34 can be actuated between the first and second positions by an actuation device 68. The actuation device 68 can be any electrical, mechanical, or electro-mechanical means, such as a solenoid, or cam and follower, for example. The ignition actuation member 34 can be moved from the first position to the second position when the air-fuel mixture is compressed at or near a combustion pressure. The actuation of the ignition actuation member 34 from the first position to the second position exposes the ignition element 22*a* to the air-fuel mixture and ignites the air-fuel mixture, causing combustion within the combustion chamber 16. The actuation of the ignition actuation member 34 can be controlled to expose the ignition element 22*a* at a desired time before, during or after full compression of the air-fuel mixture, in the case of a piston-cylinder engine, top-dead center. The ignition actuation member 34 can be returned to the first position after the air-fuel mixture begins combustion. When in the first position, the ignition element 22*a* is protected from the combustion products. The ignition actuation member 34 can be returned to the first position before the combusted air-fuel mixture is expelled from the combustion chamber 16 during the exhaust stroke. The ignition actuation member 34 can further be returned to the first position before the combustion event, or power stroke is complete. FIGS. 2-7 illustrate the ignition actuation member 34 linearly moving between the first and second positions, though the ignition actuation member 34 could move in other fashions to expose the ignition element 22*a*.

With reference to FIGS. 2-5, the ICE 12 can define an isolation cavity 36, adjacent to the combustion chamber 16 and connected to the combustion chamber 16 by a combustion aperture 38. The ignition actuation member 34 can include an actuated portion 34*a*, a sealing portion 34*b* and a sealing surface 34*c* on the sealing portion 34*b*. The actuated portion can be actuated by the actuating device 68. The sealing surface 34*c* can seal the combustion aperture 38, thus isolating the isolation cavity 36 from the combustion chamber 16. The ignition element 22*a* can be located within the isolation cavity 36. The isolation cavity 36 can be sized according to the application, but generally should be sized to minimize the volume around the ignition element 22*a*. The ignition element 22*a* can be fixed to the isolation cavity 36 to remain within the isolation cavity 36 while the ignition actuation member 34 is in both the first and second positions. In such a configuration, the ignition element 22*a* may be fixed to a wall 36*a* of the isolation cavity 36 by any fastening means such as bolts, screws, adhesives, press or interference fit, or pins, for example. In other configurations, the ignition element 22*a* can be fixed to the ignition actuation member 34 to move with the ignition actuation member 34 between the first and second positions. In such a configuration, the ignition element 22*a* may be fixed to the actuated portion 34*a* of the ignition actuation member 34, or may be fixed to the sealing portion 34*b* of the ignition actuation member 34. The ignition element 22*a* may be fixed to the ignition actuation member 34 by any fastening means such as bolts, screws, adhesives, press or interference fit, or pins, for example. The ignition actuation member 34 can seal the combustion aperture 38 and isolate the ignition element 22*a* from the combustion chamber 16 in the first position (see FIG. 2). The ICE 12 can optionally include a pressure equalization channel 40. The pressure equalization channel 40 can be in communication with the combustion chamber 16 and the isolation cavity 36 to allow the pressure within the combustion chamber 16 to be hydrostatically substantially equal to the pressure within the isolation cavity 36. The pressure equalization channel 40 can be sized to the application, but generally is sufficiently small as to prevent ignition of the air-fuel mixture during pressure equalization.

Figure 2:
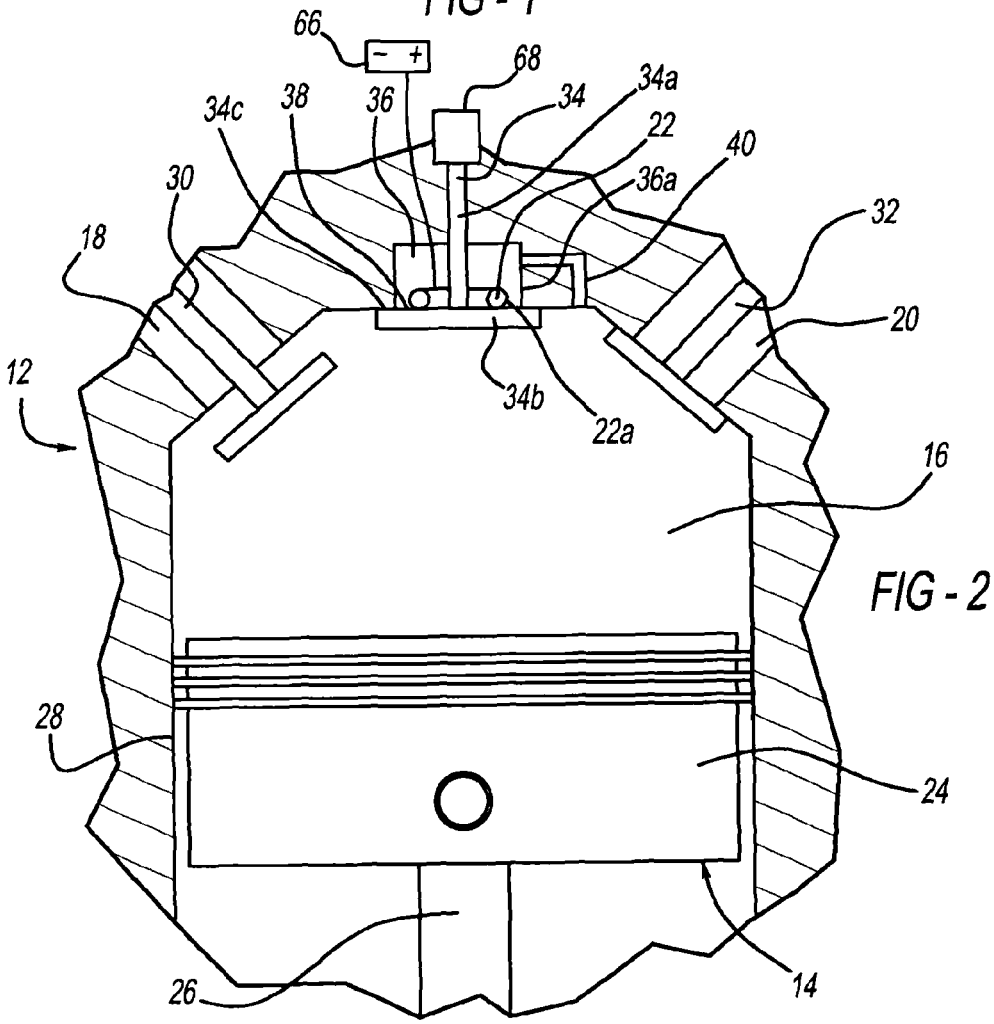
FIG. 2 is a cut-away view of a combustion chamber and ignition elements associated therewith of the internal combustion engine in a first configuration with an ignition actuation member in a first position.
Figure 3:
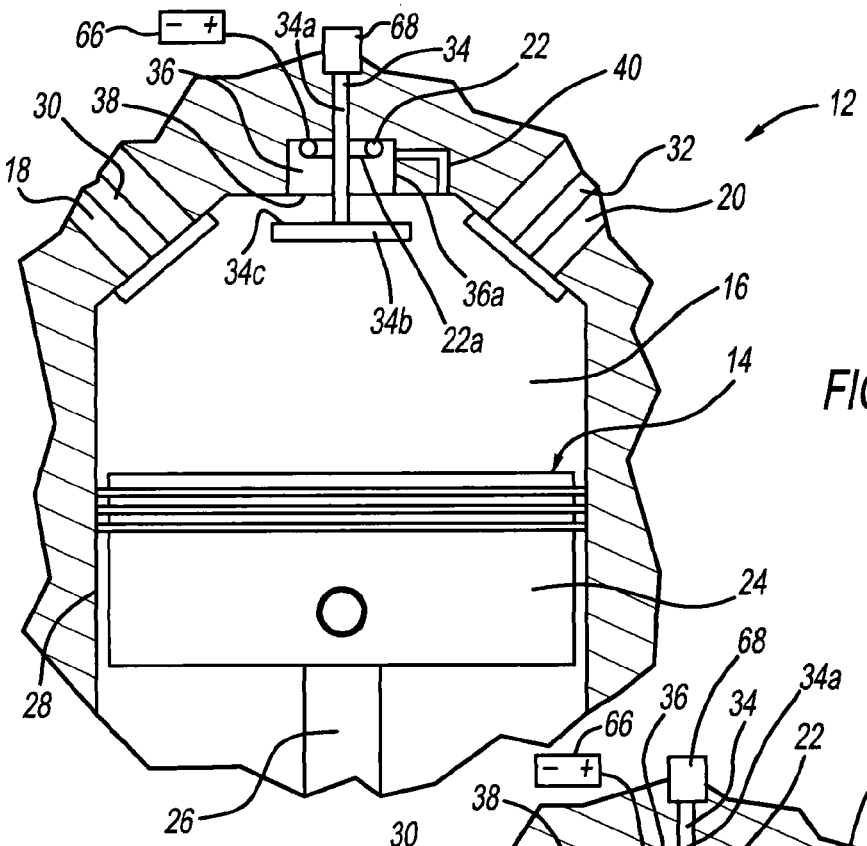
FIG. 3 is a cut-away view of a combustion chamber and ignition elements associated therewith of the internal combustion engine of FIG. 2, with the ignition actuation member in a second position.

FIG. 3 illustrates the ICE 12 of FIG. 2 with the ignition actuation member 34 in the second position. In the second position, the ignition actuation member 34 unseals the combustion aperture 38 and allows fluid communication between the ignition element 22*a* and the combustion chamber 16. The air-fuel mixture is then allowed to enter the isolation cavity 36 and ignite upon exposure to the ignition element 22*a*. In this first configuration, the ignition element 22*a* is fixed to the wall 36*a* of the isolation cavity 36 and remains within the isolation cavity 36 when the ignition actuation member 34 is in the second position. The ignition element 22*a* may be fixed to the wall 36*a* by any fastening means such as bolts, screws, adhesives, press or interference fit, or pins, for example.

Figure 4:
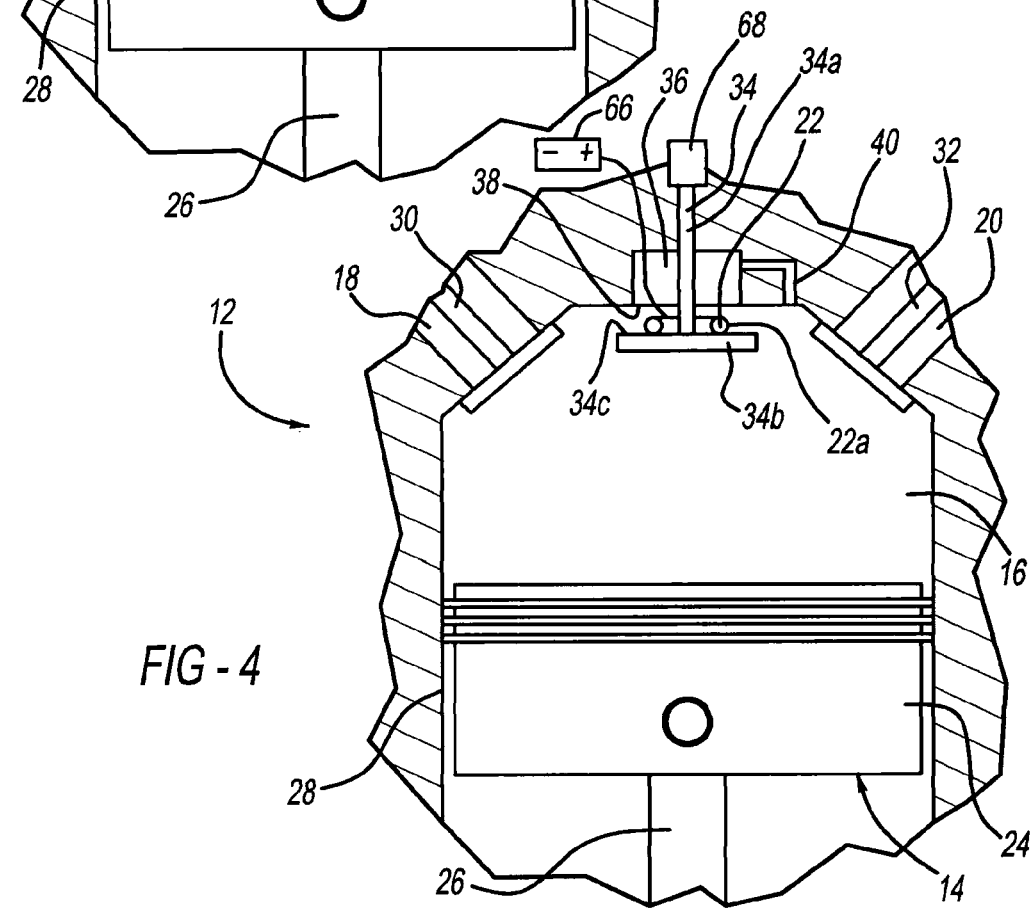
FIG. 4 is a cut-away view of a combustion chamber and ignition elements associated therewith of the internal combustion engine in a second configuration with an ignition actuation member in a second position.

FIG. 4 illustrates the ICE 12 in a second configuration, with the ignition actuation member 34 in the second position. In the second configuration, the ignition element 22*a* is coupled to the ignition actuation member 34. The ignition element 22*a* may be fixed to the actuated portion 34*a* of the ignition actuation member 34 or to the sealing portion 34*b*. The ignition element 22*a* can move between the isolation cavity 36 and the combustion chamber 16, through the combustion aperture 38, when the ignition actuation member 34 moves between the first and second positions. The ignition element 22*a* may alternatively be fixed to the actuated portion 34*a* such that it remains within the isolation cavity 36 in the second position, but moves within the isolation cavity 36 with the actuated portion 34*a*. The ignition element 22*a* may be fixed to the ignition actuation member 34 by any fastening means such as bolts, screws, adhesives, press or interference fit, or pins, for example. In the second position the ignition element 22*a* is in fluid communication with the air-fuel mixture within the combustion chamber 16 and the air-fuel mixture may be ignited.

Figure 5:
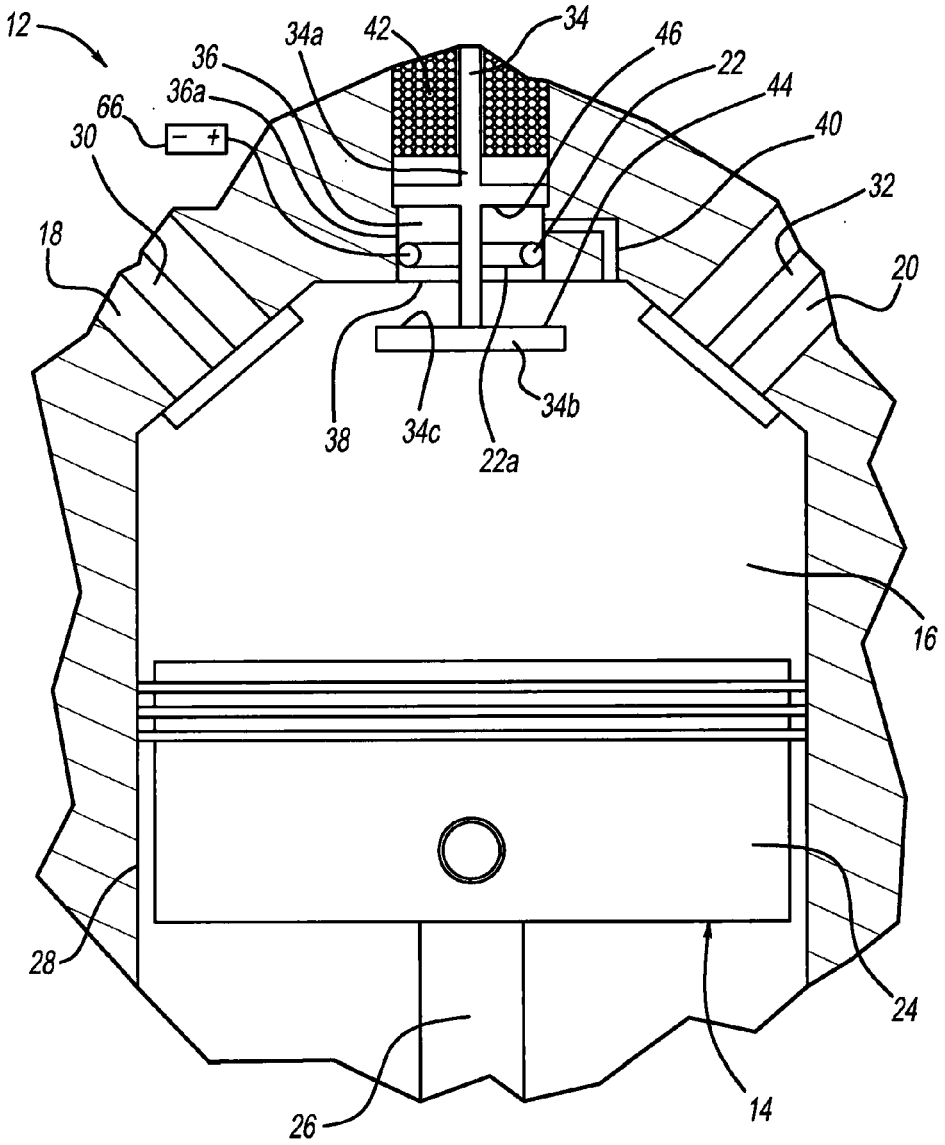
FIG. 5 is a cut-away view of a combustion chamber and ignition elements associated therewith of the internal combustion engine in a third configuration with an ignition actuation member in a second position.

FIG. 5 illustrates the ICE 12 in a third configuration, with the ignition actuation member 34 in the second position. In the third configuration, the ignition actuation member 34 is actuated between the first and second positions by a solenoid 42. The ignition actuation member 34 includes a first sealing surface 44 that seals the combustion aperture 38, isolating the ignition element 22*a* from the combustion chamber 16 when the ignition actuation member 34 is in the first position. In the second position, the first sealing surface 44 allows fluid communication between the ignition element 22*a* and the combustion chamber 16. The ignition actuation member 34 also includes a second sealing surface 46. The second sealing surface 46 fluidly isolates the solenoid 42 from the combustion chamber 16 when the ignition actuation member 34 is in the second position. While FIG. 5 shows the ignition element 22*a* fixed in the isolation cavity 36, in this configuration, the ignition element 22*a* can alternatively be fixed to the ignition actuation member 34. The ignition element 22*a* may be fixed to the isolation cavity 36 or the ignition actuation member 34 by any fastening means such as bolts, screws, adhesives, press or interference fit, or pins, for example.

Figure 6:
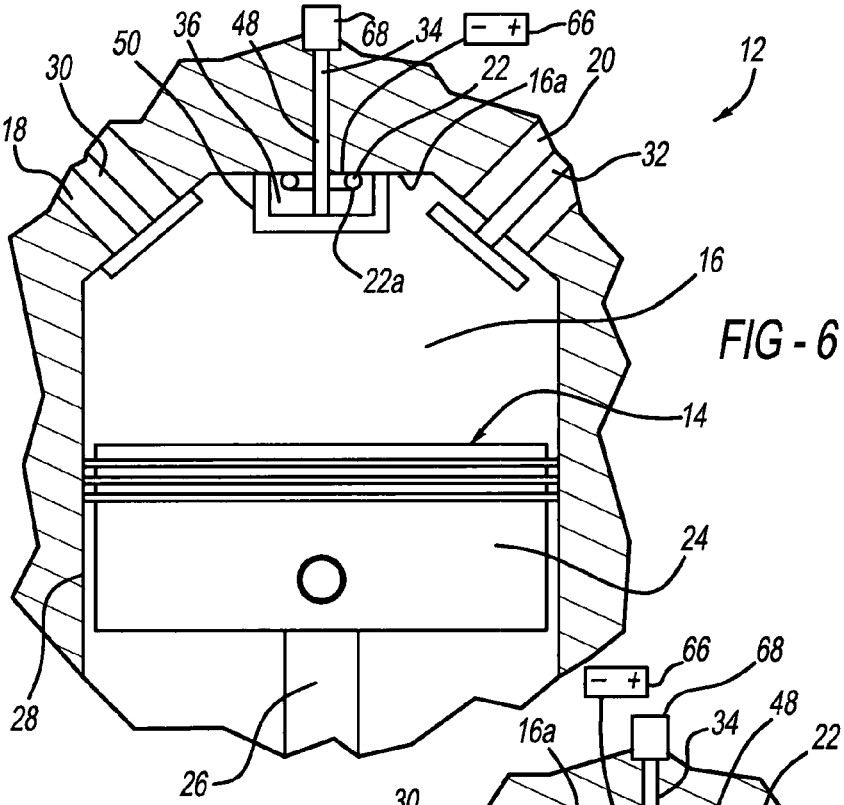
FIG. 6 is a cut-away view of a combustion chamber and ignition elements associated therewith of the internal combustion engine in a fourth configuration with an ignition actuation member in a first position.

FIG. 6 illustrates a fourth configuration of the ICE 12, with the ignition actuation member 34 in the first position. The ignition actuation member 34 includes an actuated member 48 coupled to a cap 50. The cap 50 defines the isolation cavity 36 within the combustion chamber 16. The isolation cavity 36 is fluidly isolated from the combustion chamber 16 in the first position. The ignition element 22*a* can be fixed to a wall 16*a* of the combustion chamber 16. In this configuration, the ignition element 22*a* can alternatively be fixed to either the actuated member 48 or the cap 50. The ignition element 22*a* may be fixed to the wall 16*a* or the ignition actuation member 34 by any fastening means such as bolts, screws, adhesives, press or interference fit, or pins, for example.

Figure 7:
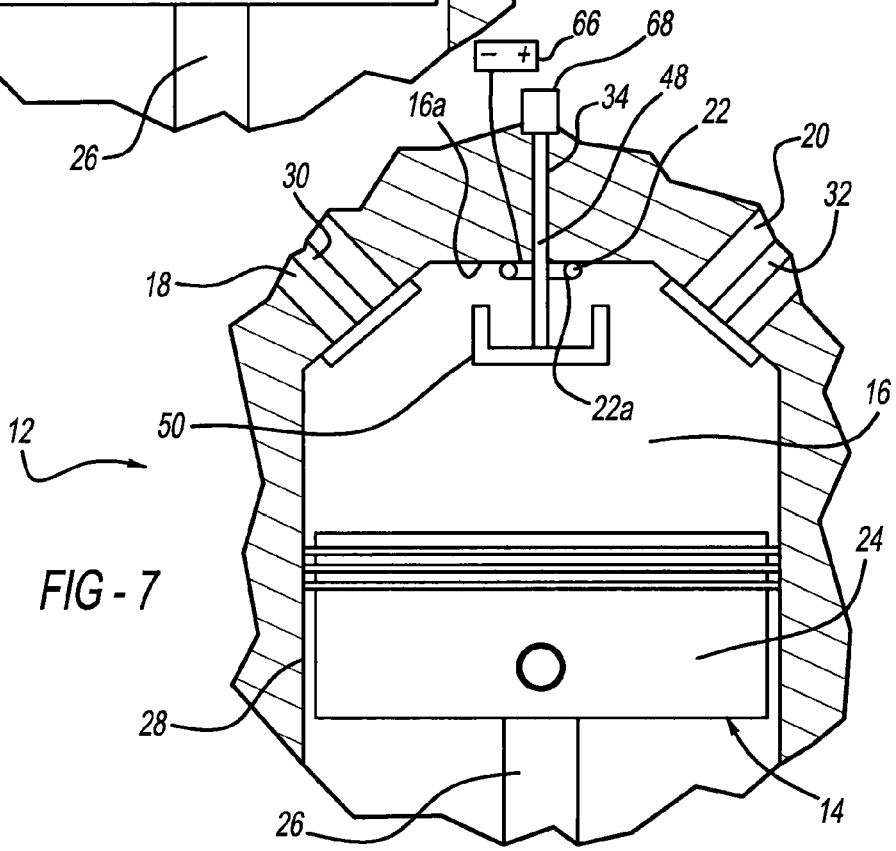
FIG. 7 is a cut-away view of a combustion chamber and ignition elements associated therewith of the internal combustion engine of FIG. 6 with the ignition actuation member in a second position.

FIG. 7 illustrates the ICE 12 of FIG. 6, with the ignition actuation member 34 in the second position. In the second position, the ignition actuation member 34 allows fluid communication between the ignition element 22*a* and the combustion chamber 16. While the ignition element 22*a* is shown fixed to the wall 16*a* of the combustion chamber 16, the ignition element 22*a* can alternatively be fixed to the ignition actuation member 34 by coupling the ignition element 22*a* to either the actuated member 48 or the cap 50.

FIGS. 8 and 9 illustrate the ICE 12 in a fifth configuration, with the ignition actuation member 34 in the first and second positions, respectively. In the fifth configuration, a main body 52 can be coupled to the combustion chamber 16. The main body 52 can include a housing portion 54, a connecting portion 56, and a protective tip 58.

The housing portion 54 can house an actuating device 60. The actuating device 60 can selectively move the ignition actuation member 34 between the first and second positions. The actuation device 60 can be any type of mechanical, electrical, or electro-mechanical device capable of selectively moving the ignition actuation member 34, such as a solenoid, for example. While in the first position, the ignition element 22*a* is within the isolation cavity 36. The ignition element 22*a* is coupled to the ignition actuation member 34, and when the ignition actuation member 34 is in the second position, the ignition element 22*a* is moved into the combustion chamber 16 by the ignition actuation member 34. The ignition element 22*a* may be fixed to the ignition actuation member 34 by any fastening means such as bolts, screws, adhesives, press or interference fit, or pins, for example.

The connecting portion 56 can couple the main body 52 to the ICE 12, and can include a series of threads 62 configured to mesh with a series of mating threads 64 located on the ICE 12, for example. The series of threads 62 and series of mating threads 64 can allow the main body 52 to be removably coupled to the ICE 12.

The protective tip 58 can isolate the ignition element 22*a* from the combustion chamber 16 when the ignition actuation member 34 is in the first position. The protective tip 58 protects the ignition element from exposure to conditions within the combustion chamber 16 while preventing the ignition element 22 from igniting the air-fuel mixture prematurely.

FIG. 10 illustrates a sixth configuration, with the ignition actuation member 34 in the first and second positions, the second position illustrated by dashed lines. In the sixth configuration, the ignition device 22 is sealed within the isolation cavity 36 by an isolation member 70. The ignition device 22 is configured to emit the ignition element 22*a* as radiation, such as infrared, or laser radiation for example. The isolation member 70 is of a material configured to allow the radiation to pass through the isolation member 70 and into the combustion chamber 16. The isolation member 70 can also be configured to focus, or concentrate the radiation within a specific area within the combustion chamber 16. The isolation member 70 can have any suitable focusing shape, such as concave or convex for example, such that the focal point of the radiation is within the combustion chamber 16. Due to the focusing of the radiation, the focal point of the radiation can be a higher temperature than the temperature of the radiation at the ignition device 22. While the isolation member 70 is described as having the suitable focusing shape, it is also contemplated that any other suitable device within the isolation cavity 36, separate or in conjunction with the isolation member 70, can have the focusing shape to focus the radiation and raise the temperature of the radiation at a focal point within the combustion chamber 16.

The ignition device 22 is attached to the ignition actuation member 34. When the ignition actuation member 34 is in the first position, the ignition device 22 is away from the combustion chamber 16, minimizing exposure of the ignition element 22*a* to the air-fuel mixture within the combustion chamber 16. When the ignition actuation member 34 is in the second position, the ignition device 22 is closer to the combustion chamber 16, increasing exposure of the ignition element 22*a* to the air-fuel mixture within the combustion chamber 16. When in the first position, the ignition element 22*a* penetrating the isolation member 70 is insufficient to ignite the air-fuel mixture within the combustion chamber 16. When in the second position, the ignition element 22*a* penetrating the isolation member 70 is sufficient to ignite the air-fuel mixture within the combustion chamber 16.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

What is claimed is:

1. An internal combustion engine combustion system, comprising:

an ignition element configured to ignite an air-fuel mixture compressed within a combustion chamber of an internal combustion engine;

an ignition actuation member movable relative to the ignition element between a first position in which the ignition actuation member prevents contact of the air-fuel mixture with the ignition element to prevent ignition of the air-fuel mixture when present in the combustion chamber, and a second position in which the ignition actuation member permits ignition of the air-fuel mixture by exposing the ignition element to the air-fuel mixture when the air-fuel mixture is present in the combustion chamber; and an isolation cavity, an isolation member, and a radiation source, the isolation member seals the radiation source within the isolation cavity when the actuation member is in the first and second positions, the radiation source is configured to produce radiation and is coupled to the actuation member to move with the actuation member between the first and second positions, the isolation member is configured to allow the radiation to pass through the isolation member to form the ignition element and ignite the air-fuel mixture when the actuation member is in the second position.

2. The combustion system of claim 1, wherein the ignition actuation member is configured to linearly move between the first and second positions.

3. The combustion system of claim 1, wherein the ignition actuation member is moved between the first position and the second position by a solenoid.

4. The combustion system of claim 1, wherein the ignition element includes a heated surface configured to be heated to a temperature sufficient to ignite the air-fuel mixture within the combustion chamber.

* * * * *